US006447112B1

(12) United States Patent
Hu et al.

(10) Patent No.: US 6,447,112 B1
(45) Date of Patent: Sep. 10, 2002

(54) RADIATION CURING SYSTEM AND METHOD FOR INKJET PRINTERS

(75) Inventors: Jia Hu, New Brighton; Charles C. Lee, Little Canada, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/562,018

(22) Filed: May 2, 2000

(51) Int. Cl.[7] ..... B41J 2/01
(52) U.S. Cl. ..... 347/102
(58) Field of Search ..... 347/102; 219/216

(56) References Cited

U.S. PATENT DOCUMENTS

| | | | | |
|---|---|---|---|---|
| 4,340,893 A | * | 7/1982 | Ort | 347/102 |
| 4,774,523 A | | 9/1988 | Beaufort et al. | 346/25 |
| 5,511,477 A | | 4/1996 | Adler et al. | 101/401.1 |
| 6,145,979 A | | 11/2000 | Caiger et al. | 347/102 |

FOREIGN PATENT DOCUMENTS

| | | | | |
|---|---|---|---|---|
| EP | 0 658 607 | | 9/1998 | C09D/11/10 |
| GB | 2 142 579 | | 1/1985 | B41M/7/00 |
| GB | 2 233 928 | | 1/1991 | B29C/41/08 |
| GB | 2 322 597 | | 2/1998 | B41M/7/00 |
| GB | 2 338 212 | | 12/1999 | B41J/2/01 |
| JP | 358081169 | * | 5/1983 | 347/102 |
| JP | 62-109645 | | 5/1987 | B41J/3/04 |
| JP | 01-133746 | | 5/1989 | B41J/3/04 |
| JP | 02-092642 | | 3/1990 | B41J/2/01 |
| JP | 06-000204 | | 7/1994 | C09D/11/00 |
| JP | 08-218016 | | 8/1996 | C09D/11/00 |
| JP | 08-218017 | | 8/1996 | C09D/11/00 |
| JP | 08-218018 | | 8/1996 | C09D/11/00 |
| WO | WO 97/04964 | | 2/1997 | B41J/2/17 |
| WO | WO97/04964 | | 2/1997 | B41J/2/17 |
| WO | WO 97/27053 | | 7/1997 | B41F/17/00 |

OTHER PUBLICATIONS

Baker, et al., "Practical Considerations for Using UV Reactive Inks in Piezo DOD Printheads", IS&Ts NIP 15: *1999 International Conference on Digital Printing Technologies*, pp. 111–115 (1999).

Noguchi, Hiromichi, "UV Curable Aqueous Ink Jet Ink: Material Design and Performance for Digital Printing," IS&T's, NIP 14, 1998 International Conference.

Baker, Richard J., "Practical Considerations for Using UV Reactive Inks in Piezo DOD Printheads," IS&T's, NIP 15, 1999 International Conference.

* cited by examiner

*Primary Examiner*—John Barlow
*Assistant Examiner*—Michael S Brooke
(74) *Attorney, Agent, or Firm*—James D. Christoff

(57) ABSTRACT

Methods and systems for curing radiation-curable inks printed on substrates using inkjet printheads are disclosed. The methods and systems include radiation sources that are either integral with a printer or that can be added to an existing printer. In either case, the radiation source preferably moves independently of the printhead to provide the desired electromagnetic curing energy to the printed ink. The radiation source and the printhead may be mounted separately and move independently such that the mass of the printhead is not significantly increased.

26 Claims, 3 Drawing Sheets

RADIATION CURING SYSTEM AND METHOD FOR INKJET PRINTERS

FIELD OF THE INVENTION

The present invention relates to the field of inkjet printing. More particularly, the present invention provides a radiation curing system and method for use with inkjet printers using radiation-curable inks.

BACKGROUND

Inkjet technology and processes for printing radiation-curable inks are known, with the most-widely investigated inks being those that are cured upon exposure to ultraviolet (UV) radiation. Radiation-curable inks offer advantages such as no volatile organic compound emissions and increased durability as compared to solvent/aqueous inks.

In spite of these advantages, radiation curable inks still suffer from the problems associated with the low viscosity state in which they are applied to a substrate. That low viscosity can be the source of a number of problems including control over dot gain (size, shape, etc.), color mixing and pooling caused by applying two inks of different colors at the same location, and coalescence. Some of these disadvantages may be more problematic when the inks are applied to impermeable substrates as opposed to porous substrates.

Various attempts to address the problems with radiation-curable inks face a number of additional difficulties. Among the difficulties are the need to move the inkjet printhead or heads across the substrate because of the excessive cost associated with providing a row of printheads sufficiently large to print on a substrate in a single pass. Printhead carriages and the mechanisms used to move them across a substrate are carefully designed to provide acceptable printing speed and accuracy. Mounting radiation sources directly on the printheads or their carriage assemblies typically results in decreased image quality and/or printing speed due to the additional mass moved during printing. It may also result in very limited or no flexibility in selecting a delay interval between printing the ink and curing it.

Attempts to address the issues of added mass on inkjet printhead carriages are discussed in International Publication No. WO 97/04964 (Caiger et al.) in which the radiation from a stationary source is delivered to the printhead carriage using an optical fiber or by the use of mirrors. In all instances, however, the radiation is delivered to the printed substrate downstream from the printing location, where downstream is in reference to the movement of the substrate relative to the printhead (which traverses the width of the substrate during printing). Depending on the speed of the substrate, the delay between printing and curing may be excessive, causing problems in dot gain control, color mixing, and coalescence.

SUMMARY OF THE INVENTION

The present invention provides methods and systems for curing radiation-curable inks printed on substrates using inkjet printheads. The methods and systems include radiation sources that are either integral with a printer or that can be added to an existing printer. In either case, the radiation source preferably moves independently of the printhead to provide the desired electromagnetic curing energy to the printed ink.

As used in connection with the present invention, "curing" may include partially or completely curing the radiation-curable ink. In some instances, the initial dose of radiation may only partially cure the ink with a later dosage provided to complete the curing process.

An advantage of the invention is that the radiation source and the printhead are mounted separately and move independently such that the mass of the printhead is not significantly affected. As discussed above, adding mass to a printhead can result in decreased image quality and/or print speed.

One advantage of the invention of at least some embodiments of the invention is the ability to control or select a curing delay, i.e., the time interval between printing of the radiation-curable ink on the substrate and curing the ink.

Another advantage of some embodiments of the invention is the ability to retrofit existing printers with a radiation source for use with radiation-curable inks.

In one aspect, the present invention provides a method for printing and curing a radiation-curable ink by providing a printhead movable in first and second directions along a printing axis and providing a radiation source movable in first and second directions along a curing axis, wherein the curing axis is parallel to and offset from the printing axis. A substrate (having first and second sides defining a substrate width therebetween) is moved in a travel direction relative to the printhead, wherein the travel direction is transverse to the printing axis. The method also includes moving the printhead between the first and second sides of the substrate along the printing axis while printing a radiation-curable ink on the substrate with the printhead and curing the radiation-curable ink by following the movement of the printhead with the radiation source while activating the radiation source. The radiation source follows the printhead during movement of the printhead in the first and second directions along the printing axis. In addition, the printhead passes between the radiation source and the substrate proximate the first and second sides of the substrate.

In another aspect, the present invention provides a method for printing and curing a radiation-curable ink by providing a printer including a printhead movable in first and second directions along a printing axis, and attaching a radiation source to the printer, the radiation source movable in the first and second directions along a curing axis, wherein the curing axis is parallel to and offset from the printing axis. A substrate (having first and second sides defining a substrate width therebetween) is moved in a travel direction relative to the printhead, wherein the travel direction is transverse to the printing axis. The method also includes moving the printhead between the first and second sides of the substrate along the printing axis while printing a radiation-curable ink on the substrate with the printhead and detecting movement of the printhead. The radiation-curable ink is cured by following the movement of the printhead with the radiation source while activating the radiation source. The radiation source follows the printhead during movement of the printhead in the first and second directions along the printing axis. In addition, the printhead passes between the radiation source and the substrate proximate the first and second sides of the substrate.

In another aspect, the present invention provides a radiation-curable ink printing system including a substrate transport apparatus defining a substrate travel direction, wherein the substrate transport apparatus includes first and second sides defining a width therebetween. The system also includes a printhead movable in first and second directions along a printing axis that is transverse to the substrate travel direction and a radiation source independent from the printhead, the radiation source being movable in the first and second directions along a curing axis that is parallel to and offset from the printing axis. The printing axis is located between the substrate transport apparatus and the curing axis such that the printhead passes between the radiation source and the substrate transport apparatus during printing.

In another aspect, the present invention provides a radiation-curable ink curing system adapted for attachment to a radiation-curable ink printer including a substrate transport apparatus defining a substrate travel direction, wherein the substrate transport apparatus has first and second sides defining a width therebetween. The printer also includes a printhead movable along a printing axis that is transverse to the substrate travel direction. The system includes a radiation source movable in first and second directions along a curing axis that is parallel to and offset from the printing axis. The radiation source is attached to the printer such that the printing axis is located between the substrate transport apparatus and the curing axis, wherein the printhead passes between the radiation source and the substrate transport apparatus during printing.

These and other various features and advantages of the invention are described below with reference to various illustrative embodiments of the invention and examples of the invention.

BRIEF DESCRIPTION OF THE INVENTION

DESCRIPTION OF ILLUSTRATIVE EMBODIMENTS OF THE INVENTION

Figure 1:
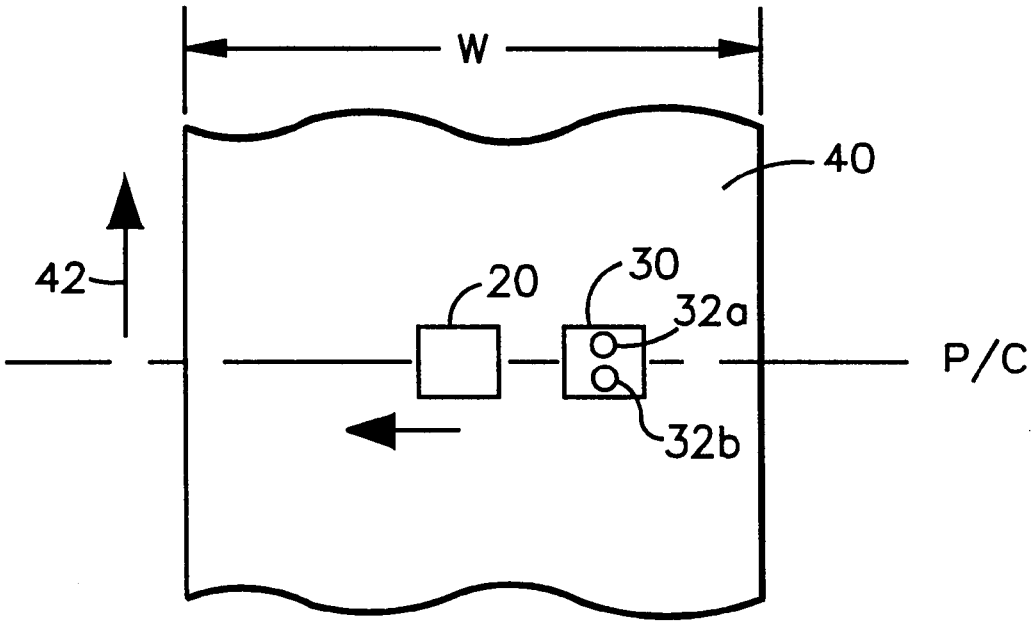
FIG. 1 is a schematic diagram of one system according to the present invention with the printhead traversing the width of the substrate from right to left.
Figure 2:
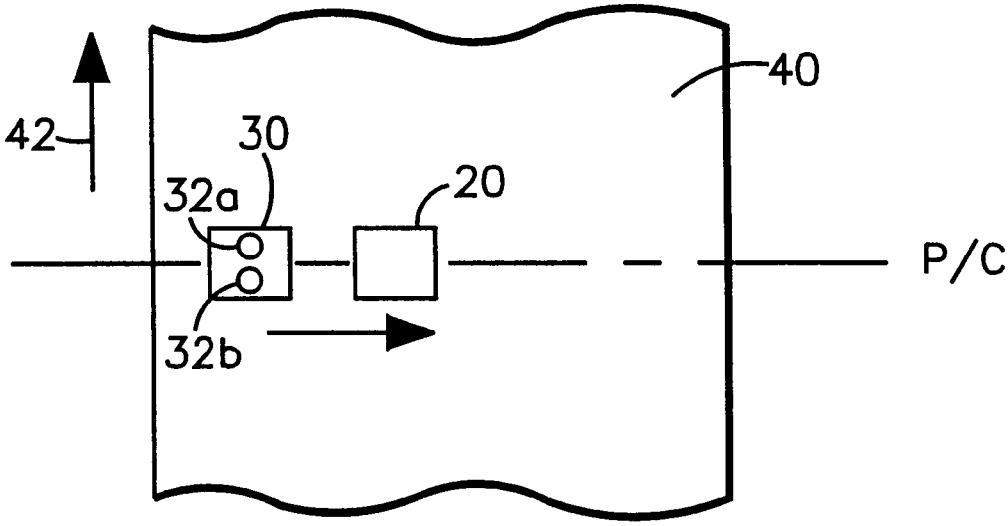
FIG. 2 is a schematic diagram of the system of FIG. 1 with the printhead traversing the substrate from left to right.
Figure 3:
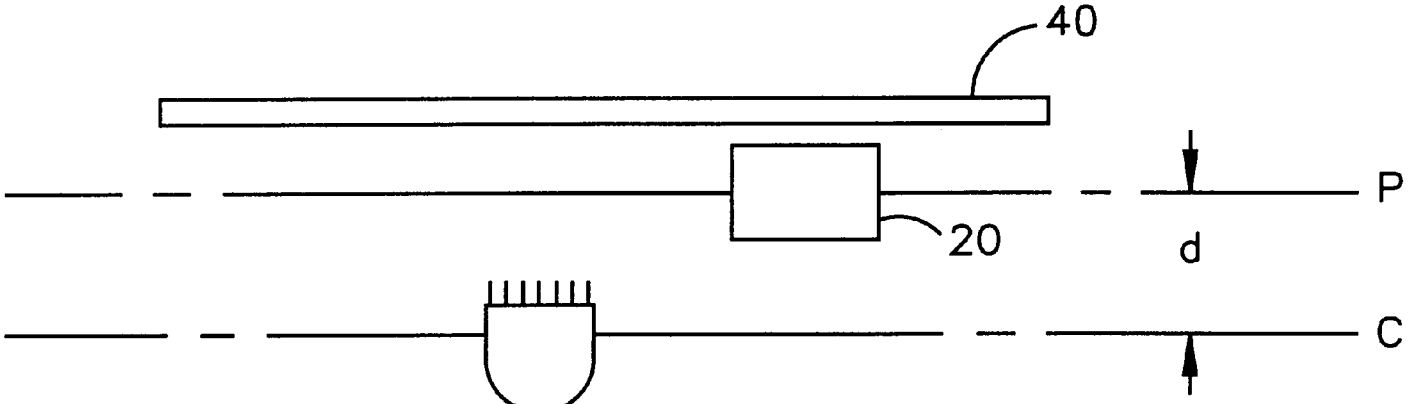
FIG. 3 is a schematic diagram of the system of FIGS. 1 and 2 taken from the direction illustrated by line 3—3 in FIG. 2.

FIGS. 1–3 are schematic diagrams of one system according to the present invention. The system 10 includes a printhead 20 and a radiation source 30. In use, the printhead 20 includes at least one inkjet for printing a radiation-curable ink on a substrate 40. The printhead 20 may be of any suitable inkjet printhead design that is capable of applying a radiation-curable ink to the substrate 40. Examples of printheads that may be used may be manufactured by a variety of companies, e.g., Canon, Hewlett-Packard, Spectra, Inc. (Hanover, N.H.), Xaar Technologies Limited (Cambridge, GB), etc.

The particular design features of the printhead 20 are not important to the present invention provided the printhead is capable of applying a radiation-curable ink to the substrate. It may be preferred that the radiation-curable ink be an ultraviolet-curable ink. Alternatively, the radiation-curable ink may be cured by exposure to other forms of electromagnetic radiation of any selected wavelength or range of wavelengths, including but not limited to, for example, infrared, electron beam, etc.

The printhead 20 is mounted for movement along printing axis p that is preferably transverse to the substrate travel direction 42. The printhead 20 is capable of printing when moving in either direction along the printing axis p. Printhead driving mechanisms for moving the printhead 20 along a printing axis in this manner are well-known and will not be described further herein, although it is noted that they may often include a motor, belt and position encoder.

The radiation source 30 includes at least one radiation emitter, and may, in some instances include two or more emitters 32*a* and 32*b*. For example, the radiation source may include an ultraviolet lamp or other radiation emitter that produces radiation capable of curing the radiation-curable ink printed by the printhead 20. It may be preferred that the radiation source 30 include a plurality of radiation emitters such that curing does not completely cease with, e.g., the failure of one lamp. The radiation emitters may possess any number of a variety of characteristics depending on the requirements for curing the ink being printed, e.g., focused, unfocused, diffuse, narrow band, broadband, collimated, uncollimated, etc. In another variation, the radiation source may include two or more emitters that emit electromagnetic radiation in different areas of the electromagnetic energy spectrum.

The radiation source 30 is mounted for movement along curing axis c that is preferably parallel to and spaced from the printing axis p. By "parallel" as used herein, it is meant that the curing axis may be perfectly parallel or slightly off of parallel to the printing axis, provided that any variations from perfectly parallel do not significantly affect the curing process. Driving mechanisms for moving assemblies such as the radiation source 30 will generally be similar to those used to move, e.g., the printhead 20. Differences may include a reduced need for precise movement that is typically required by printhead driver mechanisms to ensure accurate printing.

It is preferred, but not required, that the radiation source 30 driving mechanism be independent of the printhead 20 and/or its driving mechanism. As used in connection with the present invention, this "independence" means that the mechanisms used to drive the printhead 20 and radiation source 30 are not physically coupled to each other (although movement of the radiation source 30 is typically based on movement of the printhead 20). Alternatively, a single motor may drive both the printhead 20 and radiation source 30 with appropriate gearing, clutches, etc.

Separate or independent control over the movement of the printhead 20 and radiation source 30 may be used to adjust the curing delay, i.e., the time interval between printing of the radiation-curable ink on the substrate and when the radiation used to cure that ink is incident on the printed ink. In some instances, a longer curing delay may be desirable to allow, e.g., the printed ink to flow to achieve required dot gain. In other instances, it may be desirable to provide a shorter curing delay. Regardless, by providing the ability to select a predetermined time interval for the curing delay, image quality and/or printing speed may be improved as compared to known systems.

The actual techniques by which the curing delay may be adjusted may vary and may be implemented mechanically (e.g., by the use of cams and followers), electronically (using hardware, software, or a combination of hardware and software), or a combination of mechanical and electrical systems.

It will be noted that the printing and curing axes p and c are aligned in the views of FIGS. 1 and 2 along the direction indicated by arrow 42. This arrangement is preferred to place the radiation source 30 directly in line with the printhead 20. Although this arrangement is preferred, it is not required and some variation in the alignment of the printing and curing axes along the direction of arrow 42 can be tolerated.

The substrate 40 travels relative to the printhead 20 in the travel direction 42. Although the invention will be described as including a moving a substrate 40, it should be understood that, alternatively, the printhead 20 and radiation source 30 could be moved in the direction of arrow 42 while the substrate 40 remained stationary. Typically, however, it will be easier to move the substrate 40 while holding the printhead 20 and radiation source 30 stationary (except for movement along their respective axes across the width of the substrate 40).

The substrate 40 may be provided in the form of a sheet having a defined length or a web having a substantially continuous undefined length. If provided in web form, the substrate may be unwound from a roll (not shown) or it may be manufactured in-line with the printing system by, e.g., extrusion or other methods. Regardless of whether the substrate 40 is provided as a continuous web or in sheet form, it will typically have a width w between its sides, with the width being measured transverse to the substrate travel direction 42. By "transverse" as used herein, it is meant that the width of the substrate may be offset by exactly 90 degrees from the substrate travel direction or the substrate width and the travel direction may be slightly more or less than 90 degrees, provided that any variations from perfectly transverse do not significantly affect the printing and/or curing processes.

During printing and curing, the printhead 20 leads in either direction across the width of the substrate 40. The radiation source 30 follows the movement of the printhead 20 to expose the ink printed by the printhead to curing radiation. This following (or trailing) movement is illustrated in FIGS. 1 and 2, where the radiation source 30 trails the printhead 20 as it moves in the printing direction 22 across the width of the substrate 40.

Another feature of the methods and systems of the invention is depicted in FIG. 3 where placement of the radiation source 30 relative to the printhead 20 and substrate 40 are illustrated. The printhead 20 will typically be mounted in close proximity to the substrate 40 for print quality reasons. In the present invention, it is preferred that the radiation source 30 move along a curing axis c that is spaced from the printhead 20 and its associated printing axisp by a spacing distance d illustrated in FIG. 3. That distance d is preferably large enough to allow the printhead 20 to pass freely through the space between the radiation source 30 and the substrate 40.

The advantage of this spatial arrangement is that, at the ends of the printhead movement (proximate the sides of the substrate 40), the order of travel of the printhead 20 and the radiation source 30 can be reversed. In other words, for the radiation source 30 to follow the printhead 20 after it completes a pass across the width of the substrate 40, the printhead 20 must pass between the radiation source 30 and the substrate 40 (or at least the plane in which the substrate 40 is located). Alternatively, the radiation source 30 may be advanced past the printhead 20 after the printhead 20 completes a pass across the width of the substrate 40. Regardless of the movement particulars, however, at each side of the substrate 40 the printhead 20 will be located between the radiation source 30 and the substrate 40 (or the plane in which the substrate 40 is located) at some point as the printhead 20 changes direction to move back across the substrate 40.

Figure 4:
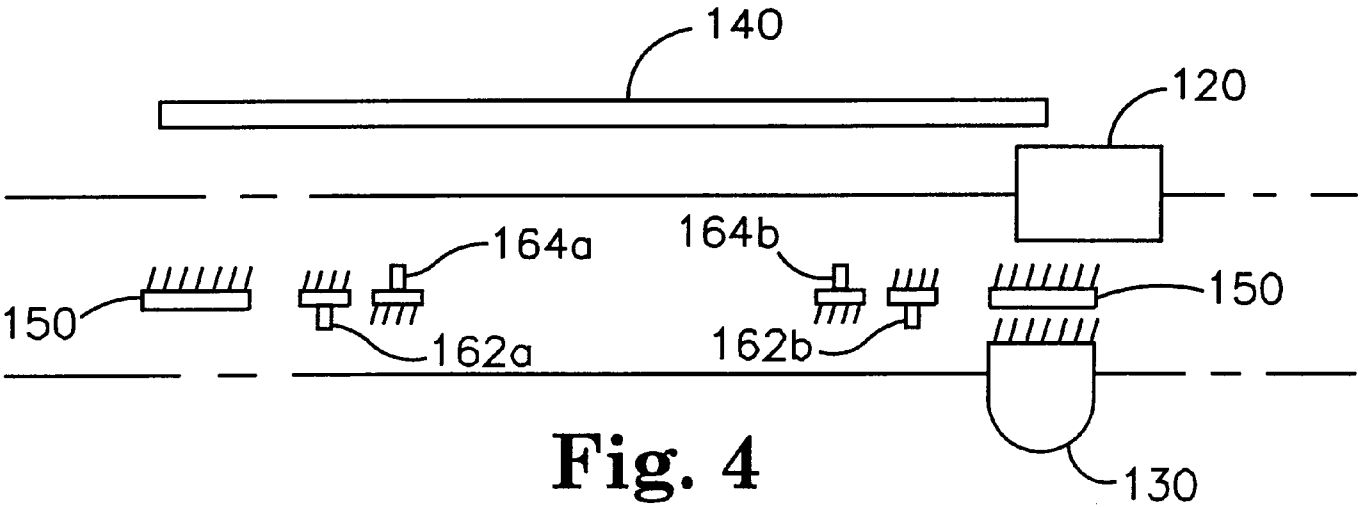
FIG. 4 is a schematic diagram of another system according to the present invention.

FIG. 4 illustrates another system 110 according to the present invention. In addition to the printhead 120, radiation source 130, and substrate 140 which are similar to the corresponding components illustrated in connection with FIGS. 1–3, the system 110 further includes shields 150 proximate the sides of the substrate 140 (which extends into and out of the page in the view illustrated in FIG. 4). The shields 150 are provided to protect the printhead 130 from the radiation emitted by the radiation source 130 as the printhead 120 passes between the radiation source 130 and the substrate 140 (or the plane in which the substrate 140 is located).

In some instances, the intensity of the radiation from the radiation source 130 may be harmful to the printhead 120 due to heat, etc. In the absence of the shields 150, the radiation source 130 may have to be turned off as the printhead 130 passes between it and the substrate 140. This cycling of the radiation source 130 may cause a number of problems. For example, the longevity of the lamps or other emitters may be significantly reduced if they are cycled on and off each time the printhead 120 traverses the substrate 140. In addition, the uniformity of the radiation produced by the radiation source 130 may be adversely effected by cycling. For example, the intensity of the radiation emitted by the radiation source 130 may vary slightly after it is switched on until a steady-state operation is reached. Such intensity variations may result in variations in the curing effect provided by the radiation, leading to undesirable printing variations.

With the shields 150 in place, the radiation source 130 may be continuously on, emitting radiation that is shielded from the printhead 120 at the sides of the substrate 140. As a result, any problems regarding radiation source longevity and/or uniformity may be reduced.

FIG. 4 also illustrates one detection system for detecting movement of the printhead 120 and the radiation source 130. The illustrated detection system includes radiation source sensors 162*a* and 162*b* and printhead sensors 164*a* and 164*b*. As the printhead 120 moves past printhead sensor 164*b* to traverse the substrate 140, the radiation source 130 can be activated to follow the printhead 120 across the substrate 140. Failure of the radiation source 130 to move out of its home position (proximate shield 150) may be detected by the radiation source sensor 162*b* after an appropriate interval of time. That failure can then be used to stop the printing process because the ink printed in that pass will not be cured.

Assuming the radiation source 130 does, however, follow the printhead 120 as desired, the printhead 120 will preferably reach the opposite side of the substrate 140 before the radiation source 130. The printhead 120 will preferably be retained in the left-hand home position until the radiation source 130 completes its pass across the substrate 140 to cure the ink printed by the printhead 120. Completion of the curing process can be detected, e.g., by the radiation source sensor 162*a* which detects passage of the radiation source 130 as it moves to its left-hand home position in front of the left shield 150.

After the radiation source 130 has completed its curing pass across the substrate 140, the printhead 120 can be driven back across the substrate 140 towards the right side, with its passage being detected by printhead sensor 164*a*. The radiation source 130 can then be driven to follow the printhead 120 and cure the printed ink.

The sensors illustrated in FIG. 4 may be of any suitable design, e.g., photosensors, proximity switches, etc. The signals generated by the sensors can be monitored using hardware, software, or a combination of hardware and software.

Figure 5:
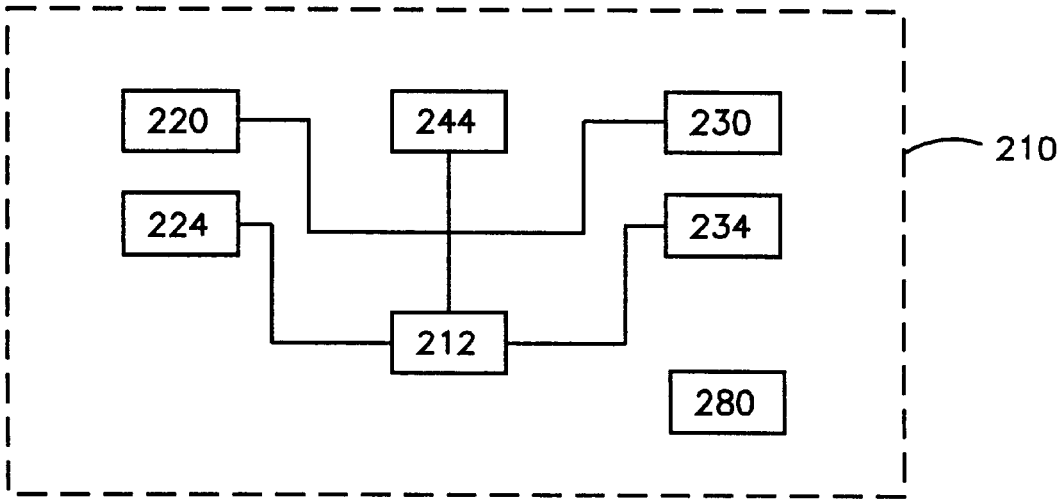
FIG. 5 is a block diagram of a printer including an integrated radiation curing system in accordance with one embodiment of the present invention.

FIG. 5 is a schematic diagram of a printer 210 according to the present invention. The printer 210 illustrates one embodiment of the present invention in which the radiation source 230 is an integrated component in the printer 210 along with the printhead 220. Also illustrated in FIG. 5 is a printhead driving mechanism 224 and a radiation source driving mechanism 234, with the two driving systems preferably being independent of each other. A substrate transport apparatus 244 is also include in the printer 210 to move a substrate beneath the printhead 220 and radiation source 230 as discussed in connection with the various embodiments presented above.

The printer 210 also preferably includes a controller 212 that controls operation of the printhead 220, printhead driving mechanism 224, radiation source 230, radiation source driving mechanism 234, and substrate transport apparatus 244. In such an integrated system, detection of the printhead 220 movement may be effected by sensors as discussed above, or it may be effected by relying on a positioning signal generated by the controller 212 which is also used to control movement of the radiation source 230.

The illustrative system 210 depicted in FIG. 5 also includes an optional curing delay controller 280 used to adjust the curing delay, i.e., the time interval between printing of the radiation-curable ink on the substrate and curing of the ink by the radiation source. The curing delay controller 280 may be implemented mechanically (e.g., by the use of cams and followers), electronically (using hardware, software, or a combination of hardware and software), or a combination of mechanical and electrical systems. For example, the curing delay controller 280 may use a time delay mechanism that starts the radiation source 230 traversing the substrate at a selected time period after the printhead 220 begins traversing the substrate.

Figure 6:
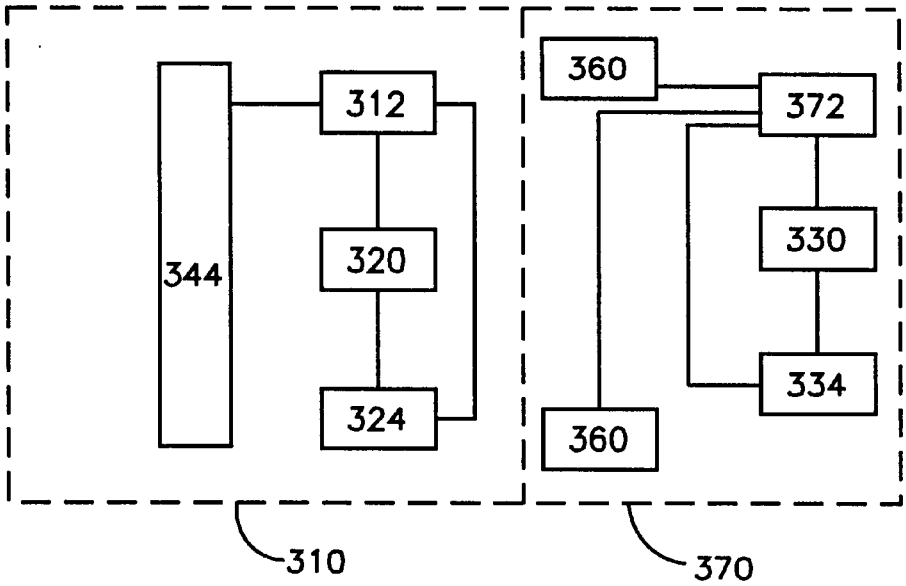
FIG. 6 is a block diagram of a printer including a retrofitted radiation curing system in accordance with another embodiment of the present invention.

FIG. 6 illustrates another variation in which an existing printer 310 is retrofitted with a curing system 370 that includes a radiation source 330 and radiation source driving mechanism 334. The printer 310 includes a printhead 320 and printhead driving mechanism 324, as well as a substrate transport apparatus 344. In this embodiment, the printer controller 312 used to control the printer components will not typically also control the curing system 370. Rather, the curing system 370 may include its own controller 372 to control movement of the radiation source 330. In addition, the curing system 370 may also include sensors 360 for detecting movement of the printhead 320, as well as movement of the radiation source 330 (if desired). Alternatively, the curing system controller 372 may receive positioning signals from the printer controller 312 that are indicative of the movement of the printhead 320. Those signals may then be used as the basis for moving the radiation source 330. This system may also include a curing delay controller as discussed above.

The preceding specific embodiments are illustrative of the practice of the invention. This invention may be suitably practiced in the absence of any element or item not specifically described in this document. The complete disclosures of all patents, patent applications, and publications are incorporated into this document by reference as if individually incorporated in total.

Various modifications and alterations of this invention will become apparent to those skilled in the art without departing from the scope of this invention, and it should be understood that this invention is not to be unduly limited to illustrative embodiments set forth herein, but is to be controlled by the limitations set forth in the claims and any equivalents to those limitations.

What is claimed is:

1. A method for printing and curing a radiation-curable ink comprising:

providing a printhead movable in first and second directions along a printing axis;

providing a radiation source movable in first and second directions along a curing axis, wherein the curing axis is parallel to and offset from the printing axis;

moving a substrate in a travel direction relative to the printhead, wherein the travel direction is transverse to the printing axis, and further wherein the substrate comprises first and second sides defining a width of the substrate therebetween;

moving the printhead along the printing axis while printing a radiation-curable ink on the substrate with the printhead; and curing the radiation-curable ink by following the movement of the printhead with the radiation source while activating the radiation source;

wherein the radiation source follows the printhead during movement of the printhead in the first and second directions along the printing axis;

and further wherein the printhead passes between the radiation source and the substrate proximate the first and second sides of the substrate.

2. The method of claim 1, wherein the curing is performed after a curing delay comprising the time between printing and curing the radiation-curable ink, and further wherein the method comprises adjusting the curing delay to a selected time interval.

3. The method of claim 1, further comprising continuously activating the radiation source during printing.

4. The method of claim 1, further comprising:

providing a radiation shield between the radiation source and printhead proximate the first side of the substrate;

providing a radiation shield between the radiation source and printhead proximate the second side of the substrate;

continuously activating the radiation source during printing; and shielding the printhead from the radiation source with one of the shields when the printhead passes between the radiation source and the substrate proximate the first and second sides of the substrate.

5. The method of claim 1, further comprising;

stopping the printhead proximate the first side of the substrate until the radiation source reaches the first side of the substrate; and moving the printhead towards the second side of the substrate after the radiation source reaches the first side of the substrate.

6. The method of claim 1, wherein the printhead moves independently of the radiation source.

7. A method for printing and curing a radiation-curable ink comprising:

providing a printer comprising a printhead movable in first and second directions along a printing axis;

attaching a radiation source to the printer, the radiation source movable in the first and second directions along a curing axis, wherein the curing axis is parallel to and offset from the printing axis;

moving a substrate in a travel direction relative to the printhead, wherein the travel direction is transverse to the printing axis, and further wherein the substrate comprises first and second sides defining a width of the substrate therebetween;

moving the printhead along the printing axis while printing a radiation-curable ink on the substrate with the printhead;

detecting movement of the printhead;

curing the radiation-curable ink by following the movement of the printhead with the radiation source while activating the radiation source;

wherein the radiation source follows the printhead during movement of the printhead in the first and second directions along the printing axis;

and further wherein the printhead passes between the radiation source and the substrate proximate the first and second sides of the substrate.

8. The method of claim 7, wherein the curing is performed after a curing delay comprising the time between printing and curing the radiation-curable ink, and further wherein the method comprises adjusting the curing delay to a selected time interval.

9. The method of claim 7, further comprising continuously activating the radiation source during printing.

10. The method of claim 7, further comprising:

providing a radiation shield between the radiation source and printhead proximate the first side of the substrate;

providing a radiation shield between the radiation source and printhead proximate the second side of the substrate;

continuously activating the radiation source during printing, and shielding the printhead from the radiation source with one of the shields when the printhead passes between the radiation source and the substrate proximate the first and second sides of the substrate.

11. The method of claim 7, wherein the detecting comprises sensing the printhead movement with sensors.

12. The method of claim 7, wherein the detecting comprises receiving a signal from the printer indicating movement of the printhead.

13. The method of claim 7, further comprising;

stopping the printhead proximate the first side of the substrate until the radiation source reaches the first side of the substrate; and moving the printhead towards the second side of the substrate after the radiation source reaches the first side of the substrate.

14. The method of claim 7, wherein the printhead moves independently of the radiation source.

15. A radiation-curable ink printing system comprising:

a substrate transport apparatus defining a substrate travel direction, wherein the substrate transport apparatus comprises first and second sides defining a width therebetween;

a printhead movable in first and second directions along a printing axis that is transverse to the substrate travel direction; and a radiation source independent from the printhead, the radiation source being movable in the first and second directions along a curing axis that is parallel to and offset from the printing axis, wherein the printing axis is located between the substrate transport apparatus and the curing axis such that the printhead passes between the radiation source and the substrate transport apparatus during printing.

16. The system of claim 15, further comprising a curing delay controller that controls the time between printing and curing the radiation-curable ink.

17. The system of claim 15, further comprising a radiation shield between the curing axis and the printing axis proximate the first side of the substrate transport apparatus and a radiation shield between the curing axis and the printing axis proximate the second side of the substrate transport apparatus, whereby the printhead is shielded from the radiation source by one of the shields when the printhead passes between the radiation source and the substrate proximate the fist and second sides of the substrate.

18. The system of claim 15, further comprising a printhead movement detection system.

19. The system of claim 18, wherein the detection system comprises sensors actuated by movement of the printhead.

20. The system of claim 18, wherein the detection system comprises a signal receiver capable of receiving signals indicating movement of the printhead.

21. A radiation-curable ink curing system adapted for attachment to a radiation-curable ink printer comprising a substrate transport apparatus defining a substrate travel direction, wherein the substrate transport apparatus comprises first and second sides defining a width therebetween, and a printhead movable along a printing axis that is transverse to the substrate travel direction, the system comprising:

a radiation source movable in first and second directions along a curing axis that is parallel to and offset from the printing axis;

wherein the radiation source is attached to the printer such that the printing axis is located between the substrate transport apparatus and the curing axis, wherein the printhead passes between the radiation source and the substrate transport apparatus during printing.

22. The system of claim 21, further comprising a curing delay controller that controls the time between printing and curing the radiation-curable ink.

23. The system of claim 21, further comprising a radiation shield between the curing axis and the printing axis proximate the first side of the substrate transport apparatus and a radiation shield between the curing axis and the printing axis proximate the second side of the substrate transport apparatus, whereby the printhead is shielded from the radiation source by one of the shields when the printhead passes between the radiation source and the substrate proximate the first and second sides of the substrate.

24. The system of claim 21, further comprising a printhead movement detection system.

25. The system of claim 24, wherein the detection system comprises sensors actuated by movement of the printhead.

26. The system of claim 24, wherein the detection system comprises a signal receiver capable of receiving signals indicating movement of the printhead.

* * * * *